US008720120B2

(12) United States Patent
Chaffee

(10) Patent No.: US 8,720,120 B2
(45) **Date of Patent: *May 13, 2014**

(54) MEMBRANE DEFLATION IN COMBINATION WITH RIGID SURFACES

(76) Inventor: Robert B. Chaffee, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/238,294

(22) Filed: Sep. 29, 2005

(65) Prior Publication Data

US 2006/0032188 A1 Feb. 16, 2006

Related U.S. Application Data

(63) Continuation of application No. 10/113,835, filed on Apr. 1, 2002, now Pat. No. 6,964,134.

(60) Provisional application No. 60/280,040, filed on Mar. 30, 2001.

(51) Int. Cl.
*E04B 1/34* (2006.01)

(52) U.S. Cl.
USPC ..... 52/2.17; 5/12.1; 5/413 R; 5/655.3; 5/706; 5/710

(58) Field of Classification Search
USPC ..... 52/2.17, 2.11, 2.13, 2.19, 2.22; 5/706, 5/410, 655.3, 413, 71, 12.1, 655, 713, 5/655.5, 618, 665, 671, 678; 248/188.6, 248/631, 397, 393; 108/42, 43; 254/93 HP; 403/188.6, 393, 397, 631
See application file for complete search history.

(56) References Cited

U.S. PATENT DOCUMENTS 388,037 A 8/1888 Hargin
847,758 A * 3/1907 Frye ..... 5/604

(Continued)

FOREIGN PATENT DOCUMENTS

CN 2195244 Y 4/1995
CN 2279102 Y 4/1998

(Continued)

OTHER PUBLICATIONS

European Search Report from corresponding European Application No. 07104463.0-2313, dated Jun. 28, 2007.

(Continued)

*Primary Examiner* — Gregory Binda
*Assistant Examiner* — Nahid Amiri
(74) *Attorney, Agent, or Firm* — Lando & Anastasi LLP

(57) ABSTRACT

The present invention is related to inflatable devices, and, more specifically, to inflatable devices in combination with rigid surfaces and a method for deflating an inflatable device. According to one embodiment of the present invention an inflatable device is provided. The inflatable device includes a substantially fluid impermeable bladder and an outlet in the bladder. The inflatable device also includes a first substantially rigid surface in contact with a first surface of the fluid impermeable bladder and a second substantially rigid surface in contact with the first surface of the fluid impermeable bladder. In this embodiment, the first and second substantially rigid surfaces collectively are in contact with more than half of the first surface of the fluid impermeable barrier. According to another embodiment of the present invention, a method of deflating an inflatable device is provided. This method includes positioning a first and a second substantially rigid surface in contact with a first surface of the inflatable device such that the first and second substantially rigid surfaces collectively are in contact with more than half of the first surface of the fluid impermeable barrier. The method further includes applying pressure to at least one of the first and second substantially rigid surfaces to force air out of the bladder.

42 Claims, 8 Drawing Sheets

(56) References Cited

U.S. PATENT DOCUMENTS

| | | | | | |
|---|---|---|---|---|---|
| 1,282,980 | A | | 10/1918 | Takach | |
| 1,576,211 | A | | 3/1926 | O'Kane | |
| 1,944,466 | A | | 1/1934 | Rubin | |
| 2,369,736 | A | | 2/1945 | Hurt | |
| 2,372,218 | A | | 3/1945 | Manson et al. | |
| 2,415,150 | A | | 2/1947 | Stein | |
| 2,549,597 | A | | 4/1951 | Harris | |
| 2,604,641 | A | | 7/1952 | Reed | |
| D167,871 | S | | 9/1952 | Vega | |
| 2,741,780 | A | | 4/1956 | Kimbrig | |
| 2,842,783 | A | | 7/1958 | Druck | |
| 2,853,720 | A | | 9/1958 | Friedlander | |
| 3,042,941 | A | | 7/1962 | Marcus | |
| 3,112,502 | A | * | 12/1963 | Forsberg | 5/708 |
| 3,128,480 | A | | 4/1964 | Lineback | |
| 3,145,853 | A | | 8/1964 | Langenberg | |
| 3,155,991 | A | | 11/1964 | Dunham | |
| 3,256,440 | A | | 6/1966 | Stark | |
| 3,274,624 | A | | 9/1966 | Noerdinger | |
| 3,375,619 | A | | 4/1968 | Hurkamp | |
| 3,584,323 | A | | 6/1971 | Worley | |
| 3,629,875 | A | | 12/1971 | Dow et al. | |
| 3,722,569 | A | | 3/1973 | Hughes | |
| 3,755,832 | A | * | 9/1973 | Bennett | 5/2.1 |
| 3,772,717 | A | | 11/1973 | Yuen et al. | |
| 3,790,975 | A | | 2/1974 | Philipp et al. | |
| 3,798,686 | A | | 3/1974 | Gaiser | |
| 3,813,716 | A | | 6/1974 | Francis | |
| 3,877,092 | A | | 4/1975 | Gaiser | |
| 4,025,974 | A | | 5/1977 | Lea et al. | |
| 4,091,482 | A | | 5/1978 | Malcolm | |
| 4,149,285 | A | | 4/1979 | Stanton | |
| 4,169,295 | A | | 10/1979 | Darling | |
| 4,371,999 | A | | 2/1983 | Reid | |
| 4,382,306 | A | | 5/1983 | Lickert | |
| 4,389,961 | A | | 6/1983 | Parish | |
| 4,417,639 | A | | 11/1983 | Wegener | |
| 4,594,743 | A | * | 6/1986 | Owen et al. | 5/111 |
| 4,644,597 | A | | 2/1987 | Walker | |
| 4,686,719 | A | | 8/1987 | Johnson et al. | |
| 4,774,735 | A | | 10/1988 | Sanderson et al. | |
| 4,778,216 | A | * | 10/1988 | Stupakis | 297/17 |
| 4,780,921 | A | * | 11/1988 | Lahn et al. | 5/630 |
| 4,862,533 | A | | 9/1989 | Adams | |
| 4,896,389 | A | | 1/1990 | Chamberland | |
| 4,977,633 | A | | 12/1990 | Chaffee | |
| 4,982,466 | A | | 1/1991 | Higgins et al. | |
| 5,068,933 | A | | 12/1991 | Sexton | |
| 5,117,517 | A | | 6/1992 | Su | |
| D335,999 | S | | 6/1993 | Van Driessche | |
| 5,216,769 | A | * | 6/1993 | Eakin | 5/620 |
| 5,267,363 | A | | 12/1993 | Chaffee | |
| 5,277,397 | A | | 1/1994 | Tartaglino | |
| D343,980 | S | | 2/1994 | Torchia | |
| 5,367,726 | A | | 11/1994 | Chaffee | |
| 5,454,642 | A | * | 10/1995 | De Luca | 383/3 |
| 5,474,361 | A | | 12/1995 | Hwang et al. | |
| 5,491,854 | A | * | 2/1996 | Music | 5/618 |
| 5,493,742 | A | | 2/1996 | Klearman | |
| 5,509,154 | A | | 4/1996 | Shafer et al. | |
| 5,562,484 | A | | 10/1996 | Mlynarz et al. | |
| 5,588,811 | A | | 12/1996 | Price | |
| 5,594,190 | A | * | 1/1997 | Malta | 84/453 |
| 5,598,593 | A | | 2/1997 | Wolfe | |
| 5,619,764 | A | | 4/1997 | Lopau | |
| 5,669,091 | A | * | 9/1997 | Chung | 5/687 |
| D391,435 | S | | 3/1998 | Song et al. | |
| 5,740,573 | A | | 4/1998 | Boyd | |
| 5,797,155 | A | | 8/1998 | Maier et al. | |
| 5,903,941 | A | | 5/1999 | Shafer et al. | |
| D414,976 | S | | 10/1999 | Su et al. | |
| 5,963,997 | A | | 10/1999 | Hagopian et al. | |
| 5,966,754 | A | | 10/1999 | Schuster | |
| 6,037,723 | A | | 3/2000 | Shafer et al. | |
| 6,061,856 | A | | 5/2000 | Hoffmann | |
| 6,076,214 | A | | 6/2000 | Klimenko | |
| 6,148,461 | A | | 11/2000 | Cook et al. | |
| 6,240,584 | B1 | | 6/2001 | Perez et al. | |
| 6,298,511 | B1 | | 10/2001 | Collymore | |
| 6,321,400 | B1 | | 11/2001 | Gulino | |
| 6,374,751 | B1 | * | 4/2002 | With | 108/43 |
| 6,397,417 | B1 | | 6/2002 | Switlik | |
| 6,446,289 | B1 | | 9/2002 | Su et al. | |
| D464,225 | S | | 10/2002 | Boso et al. | |
| 6,467,221 | B1 | | 10/2002 | Bigelow | |
| 6,483,264 | B1 | | 11/2002 | Shafer et al. | |
| 6,543,073 | B2 | | 4/2003 | Wu | |
| 6,568,011 | B2 | | 5/2003 | Fisher et al. | |
| 6,671,910 | B2 | * | 1/2004 | Hsu et al. | 5/710 |
| 6,701,559 | B2 | | 3/2004 | Boso et al. | |
| 6,836,914 | B1 | | 1/2005 | Tsai | |
| 6,955,527 | B2 | | 10/2005 | Yen | |
| 7,120,955 | B2 | | 10/2006 | Wang | |
| 7,127,762 | B1 | | 10/2006 | Lau | |
| 7,152,265 | B2 | | 12/2006 | Chung | |
| 7,284,291 | B2 | | 10/2007 | Wang | |
| 2002/0050010 | A1 | | 5/2002 | Shimada | |
| 2002/0116765 | A1 | | 8/2002 | Smith et al. | |
| 2003/0028971 | A1 | | 2/2003 | Chaffee | |
| 2003/0037379 | A1 | | 2/2003 | Gibson et al. | |
| 2003/0192123 | A1 | | 10/2003 | Chaffee | |
| 2004/0107503 | A1 | | 6/2004 | Tu | |

FOREIGN PATENT DOCUMENTS

| | | | |
|---|---|---|---|
| EP | 0 846 871 | A2 | 6/1998 |
| JP | S60-175168 | | 11/1985 |
| JP | H7-9159 | | 2/1995 |
| JP | 2588563 | Y2 | 1/1999 |
| JP | 2001523322 | A | 11/2001 |
| JP | 3267013 | B2 | 3/2002 |
| WO | 0187121 | A2 | 11/2001 |

OTHER PUBLICATIONS

English translation of Japanese Office Action from corresponding Japanese Application No. 2002-576-768, dated Sep. 6, 2007.

Canadian Search Report from corresponding Canadian Application No. 2442664, dated Nov. 21, 2008.

* cited by examiner

MEMBRANE DEFLATION IN COMBINATION WITH RIGID SURFACES

RELATED APPLICATIONS

This application is a continuation of and claims priority under 35 U.S.C. §120 to U.S. application Ser. No. 10/113,835, entitled "MEMBRANE DEFLATION IN COMBINATION WITH RIGID SURFACES," filed on Apr. 1, 2002, and patented on Nov. 15, 2005 as U.S. Pat. No. 6,964,134 B2, which claims priority from U.S. Provisional Application Ser. No. 60/280,040, entitled "MEMBRANE DEFLATION IN COMBINATION WITH RIGID SURFACES," filed on Mar. 30, 2001.

BACKGROUND

1. Field of the Invention

The present invention is related to inflatable devices, and, more specifically, to inflatable devices in combination with rigid surfaces, to a method for deflating an inflatable device, and to mechanisms for connecting a cover to an inflatable device.

2. Description of the Related Art

Inflatable devices are used in a variety of contexts where buoyancy or a cushioned support is needed, where space is limited or portability is desired. For example, inflatable mattresses, cushions and other body supports are used for applications such as camping, hospital bedding, and both occasional and everyday bedding in the home. Such inflatable devices have the additional advantage that the degree of inflation of the support can be adjusted to provide even support of an irregular object, such as a person. Other examples of inflatable devices include boats, rafts and other devices for use in the water.

A variety of methods are known for providing a fluid, such as air, to inflate an inflatable device. Typically, a pump is used to supply fluid to an orifice in the inflatable device. In most instances, fluid is introduced into inflatable devices through an inlet that may be sealed to retain fluid within the inflatable device. The inlet may also serve as an outlet for deflating the inflatable device. A pump for use with an inflatable device may include a motor that drives an impeller, moving the air into, or out of, the inflatable device. Motorized pumps may be powered by electricity. Typically, such electricity is provided by a connection to standard house current or, where portability is desired, by batteries.

One known inflatable device is adapted for use as a mattress and includes a bladder constructed to contain air in the shape of a mattress. The inflatable device also includes a pump connected to the bladder and adapted to inflate the bladder when connected to household electric current.

SUMMARY

According to one embodiment of the present invention an inflatable device is provided. The inflatable device includes a substantially fluid impermeable bladder and an outlet in the bladder. The inflatable device also includes a first substantially rigid surface in contact with a first surface of the fluid impermeable bladder and a second substantially rigid surface in contact with the first surface of the fluid impermeable bladder. In this embodiment, the first and second substantially rigid surfaces collectively are in contact with more than half of the first surface of the fluid impermeable barrier.

According to one embodiment of the present invention a method of deflating an inflatable device is provided. The method includes positioning a first and a second substantially rigid surface in contact with a first surface of the inflatable device such that the first and second substantially rigid surfaces collectively are in contact with more than half of the first surface of the fluid impermeable barrier and applying pressure to at least one of the first and second substantially rigid surfaces to force air out of the bladder.

According to one embodiment of the present invention an inflatable device is provided. The inflatable device includes a substantially fluid-impermeable bladder and an outlet disposed within the bladder. The inflatable device also includes a covering layer connected to a surface of the bladder that to provides access to the outlet, a portion of the covering layer covering the outlet including a tab, the tab being removably connected to at least one of a remaining portion of the covering layer and the bladder.

According to one embodiment of the present invention an inflatable device is provided. The inflatable device includes a substantially fluid-impermeable bladder and an outlet disposed within the bladder. The inflatable device also includes a covering layer comprising an opening and an anchor positioned proximate to the outlet and connected to the bladder and the covering layer.

According to one embodiment of the present invention an inflatable device is provided. The inflatable device includes a substantially fluid-impermeable bladder and an outlet disposed within the bladder. The inflatable device also includes an anchor positioned proximate to the outlet and connected to the bladder, lock connected to the anchor, and a cap hingedly connected to the lock.

According to one embodiment of the present invention an inflatable device is provided. The inflatable device includes a substantially rigid work surface sized for use as a lap desk and a substantially fluid impermeable bladder connected to the underside of the work surface.

According to one embodiment of the present invention a book stand is provided. The book stand includes first and second substantially rigid surfaces hingedly connected to one another and a substantially fluid impermeable bladder positioned between the first and second substantially rigid surfaces such that inflation and deflation of the bladder adjusts an angle between the first and second substantially rigid surfaces.

BRIEF DESCRIPTION OF DRAWINGS

The foregoing and other advantages of the present invention will be more fully appreciated with reference to the following drawings in which.

DETAILED DESCRIPTION

The present invention is directed to an inflatable device with rigid surfaces and to a method of deflating the inflatable device. It should be appreciated that "inflatable," as used herein, means inflation with air and any other fluids, including various gases and liquids, that may also be used to inflate the device of the present invention. In one embodiment, the inflatable device includes a substantially fluid impermeable bladder and an outlet in the bladder. The inflatable device also includes a first substantially rigid surface in contact with a first surface of the fluid impermeable bladder and a second substantially rigid surface in contact with the first surface of the fluid impermeable bladder. In this embodiment, the first and second substantially rigid surfaces collectively are in contact with more than half of the first surface of the fluid impermeable barrier.

Figure 1:
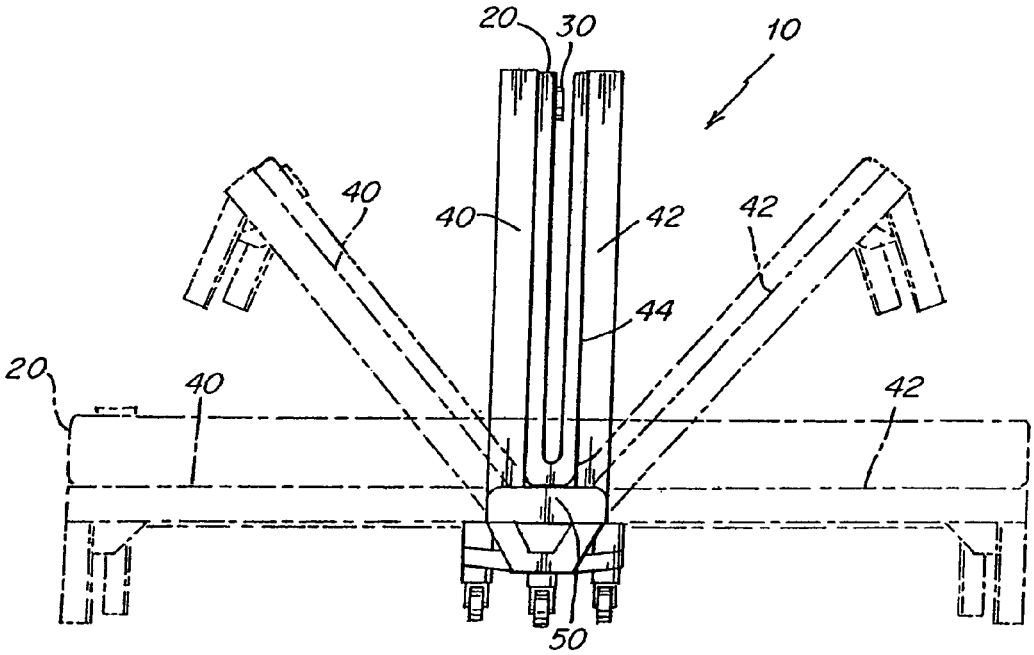
FIG. 1 is a side, elevational view of an inflatable device according to one embodiment of the present invention.
Figure 2:
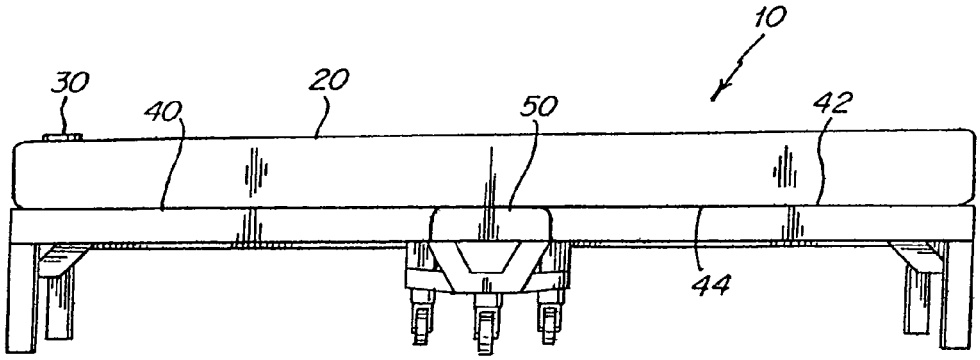
FIG. 2 is a side, elevational view of the inflatable device of FIG. 1 in an inflated condition.
Figure 3:
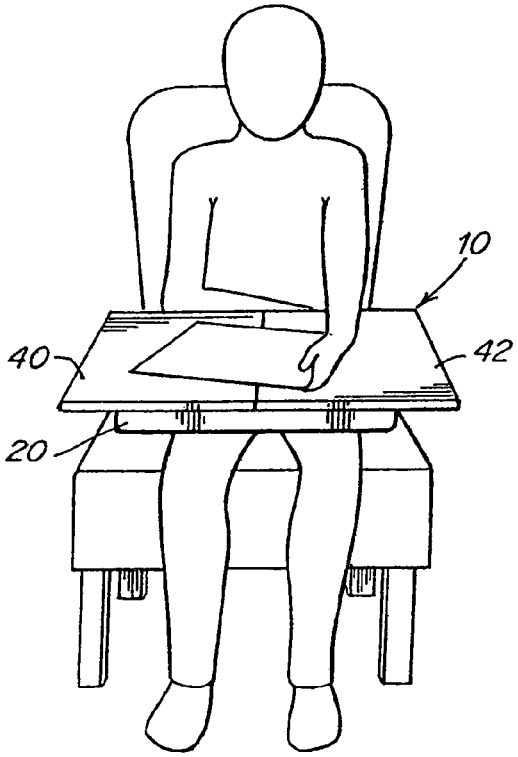
FIG. 3 is a perspective view of an inflatable device according to another embodiment of the present invention in use as a lap desk.
Figure 4:
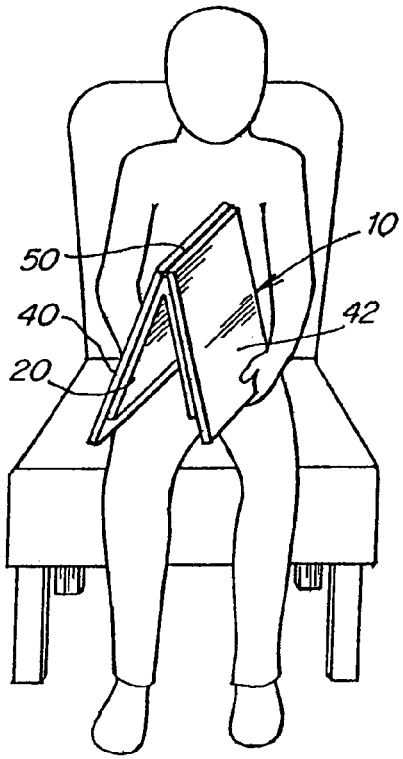
FIG. 4 is a perspective view of the inflatable device of FIG. 3 in a deflated condition.
Figure 5:
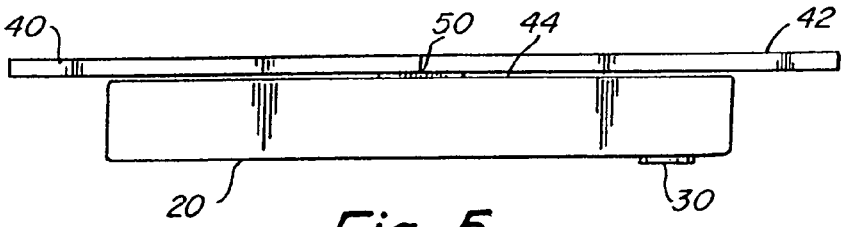
FIG. 5 is a side, elevational view of the inflatable device of FIG. 3.
Figure 6:
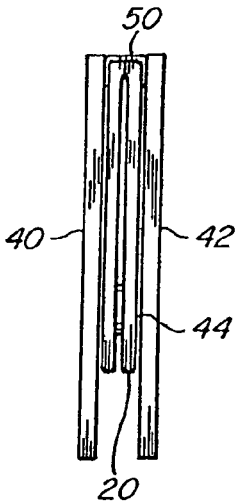
FIG. 6 is a side, elevational view of the inflatable device of FIG. 3, in a deflated condition.

Referring now to the figures and, in particular, FIGS. 1 and 2, an inflatable device 10 according to one embodiment, may include a substantially fluid impermeable bladder 20 and an outlet 30 in bladder 20. Inflatable device 10 may also include a first substantially rigid surface 40 in contact with a first surface 44 of fluid impermeable bladder 20 and a second substantially rigid surface 42 in contact with first surface 44 of fluid impermeable bladder 20. In this embodiment, first and second substantially rigid surfaces 40, 42 collectively are in contact with more than half of first surface 44 of fluid impermeable barrier 20. In use of this embodiment, pressure may be applied to first substantially rigid surface 40 at a single point and substantially rigid surface 40 will distribute that pressure generally evenly over a large portion of the first surface of bladder 20. Accordingly, it is possible to deflate bladder 20 by applying pressure to single points on substantially rigid surfaces 40, 42 to exhaust a fluid from bladder 20 via outlet 30. Thus, one advantage of this embodiment is that it alleviates a situation in which pressure may be applied to one portion of a bladder that causes fluid to move to another portion of the bladder, and not to an outlet of the bladder. Furthermore, with two substantially rigid surfaces, bladder 20 may be deflated by folding substantially rigid surfaces 40, 42 towards one another, applying pressure to bladder 20 and deflating it via outlet 30.

Figure 20:
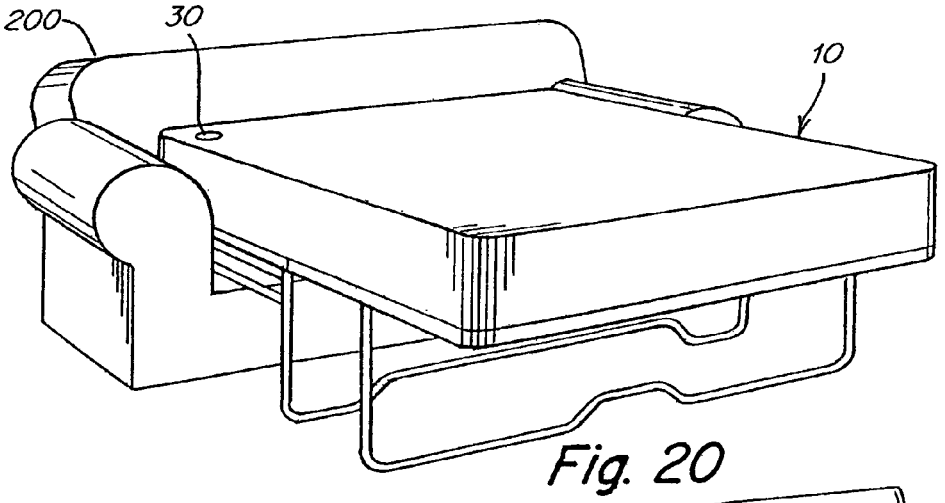
FIG. 20 is a perspective view of an inflatable device according to another embodiment of the present invention.
Figure 21:
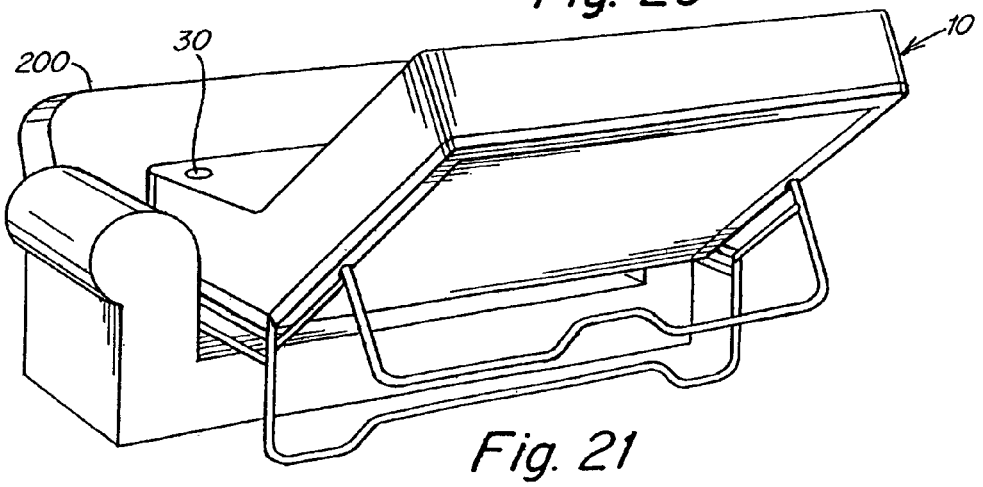
FIG. 21 is a perspective view of the inflatable device of FIG. 20 in a partially deflated condition.
Figure 22:
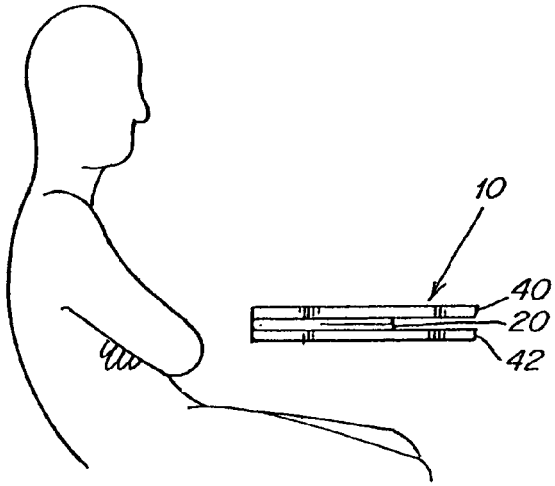
FIG. 22 is a side, elevational view of an inflatable device according to one embodiment of the present invention in a deflated condition.
Figure 23:
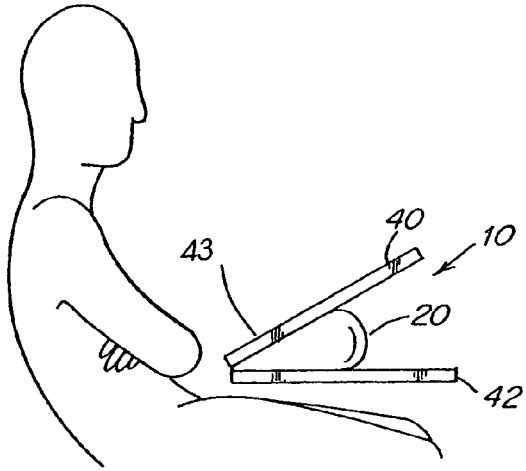
FIG. 23 is a side, elevational view of the inflatable device of FIG. 22 in a partially inflated condition.
Figure 24:
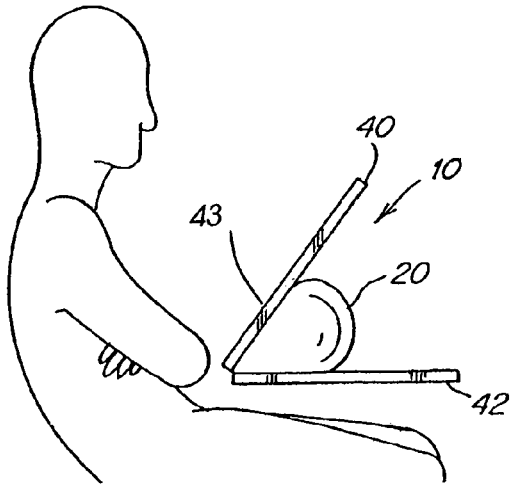
FIG. 24 is a side, elevational view of the inflatable device of FIG. 22 in a partially inflated condition.

An inflatable device having first and second substantially rigid surfaces 40, 42 may be used in a wide variety of applications. For example, as illustrated in FIGS. 1 and 2, inflatable device 10 may be constructed as a bed or cot having an inflatable mattress and first and second substantially rigid surfaces 40, 42 in the form of a supporting bed frame. By way of an alternate example, as illustrated in FIGS. 3-6, this embodiment may be used as a lap desk where bladder 20 serves as a cushion for the desk and the desk's work surface serves as first and second substantially rigid surfaces 40, 42. It will also be appreciated that the present invention will find utility in other applications having one or more substantially rigid surfaces. For example, in one embodiment, the invention may be constructed as a sleep sofa, wherein bladder 20 serves as a mattress and the frame of the sleep sofa forms at least two substantially rigid surfaces which may be folded in upon one another to deflate the mattress and stow the bed. An example of an inflatable device 10 according to the present invention for use in a sofa bed 200 is illustrated in FIGS. 20 and 21. In another embodiment, inflatable device 10 may be constructed as a book stand, for example as illustrated in FIGS. 22-24. By a book stand, it is meant a device that supports a work piece, such as a book, magazine, paper tablet, laptop, or the like, at an inclined angle, such as an easel or other desktop. In such an embodiment, substantially rigid surfaces 40, 42 may serve as a base for inflatable device 10 and a support surface for a work piece, respectively. Bladder 20 may serve as a mechanism for providing the desired angle between the rigid surfaces, with the angle and incline of one surface adjusted by the amount of fluid in the bladder. The substantially rigid surface used to support a work piece may include structure, such as a ridge 43 or shelf, intended to prevent the work piece from slipping off the support surface.

Bladder 20 may be constructed in any manner and of any material(s) capable of retaining a desired fluid under a degree of pressure necessary for its intended application. For example, bladder 20 may be constructed of a substantially fluid impermeable barrier and may be shaped in accordance with its intended use. Where bladder 20 is intended for use as a mattress, bladder 20 may be constructed in the shape and thickness of a conventional mattress. As an alternate example, where bladder 20 is constructed to provide support as a lap desk as illustrated in FIGS. 3-6, bladder 20 may be constructed as a half cylinder, rectangular polygon or other shape that will adequately support a lap desk. Bladder 20 may also be designed to provide desired comfort and to add flexibility and stability in positioning the work surface and work pieces, such as providing the working surface and materials on the work surface at a desired work height. As another example, where inflatable device 10 is constructed as a bookstand, bladder 20 may be constructed in a shape that allows the incline of the substantially rigid surface acting as a support for a work piece to be adjusted. Bladder 20 need not be constructed such that substantially rigid surfaces 40, 42 are parallel to one another when it is fully inflated, as angles greater than 90 degrees between the substantially rigid surfaces (generally corresponding to the work piece being held vertically)

will not typically be necessary in this embodiment. For example, in this embodiment bladder 20 could be generally cylindrical and arranged such that substantially rigid surfaces 40, 42 are at right angles when bladder 20 is fully inflated. Bladder 20 may also be sized and arranged such that it prevents the angle between substantially rigid surfaces 40, 42 from exceeding a certain value, such as 90 degrees. For example, bladder 20 may be constructed such that it is fully inflated when the first and second substantially rigid surfaces are at 90 degrees to one another and connected to first and second substantially rigid surfaces 40, 42 such that the angle cannot be further increased.

Bladder 20 may include internal structure, such as ribs or partitions. For example, bladder 20 may be divided into two or more separate fluid containing compartments. Bladder 20 may also include internal structure to control the movement of fluid within bladder 20. For example, bladder 20 may include baffles or walls within bladder 20 to improve the flow of fluid when bladder 20 is inflated or deflated.

A wall of bladder 20 may be any thickness required to substantially contain a fluid under pressures at which bladder 20 will be used. A thickness of the wall of bladder 20 may depend upon material from which bladder 20 is constructed. For example, more durable or elastic materials may not require the wall of bladder 20 to be as thick as less durable or elastic materials. For example, for common materials, the wall of bladder 20 may be 4-32 mils (approximately 0.1-0.8 mm) thick.

Bladder 20 may be constructed of any material or materials capable of substantially containing a fluid and forming a bladder 20 strong enough to withstand pressure at which bladder 20 is to be used. For example, bladder 20 may be constructed of a polymeric material such as a thermoplastic. Bladder 20 may be constructed from a relatively inexpensive, easy to work with and durable material. Some example materials may include polyvinyl chloride film and polyester. The manner of making bladder 20 may depend on its material of construction and configuration, as will be recognized by one of ordinary skill in the art.

Bladder 20 should include an outlet 30. Outlet 30 may be constructed in any manner and of any material(s) that allow it to permit fluid to flow from inside bladder 20 to outside bladder 20 as desired. For example, outlet 30 may be a sealable opening, such as a valve or an orifice with a mating cap. Outlet 30 may also serve as an inlet for the inflation of bladder 20. Examples of suitable structure for outlet 30 may be found in U.S. Pat. Nos. 6,237,621 B1 and 5,367,726, which are hereby incorporated by reference in their entirety. The position and size of outlet 30 may be such that fluid within bladder 20 may be expelled rapidly enough to allow inflatable device 10 to be deflated in a reasonable time. For example, outlet 30 may be positioned where bladder 20 will not obstruct it as inflatable device 10 is folded up, and may be large enough to allow adequate air flow with reasonable folding effort. In one embodiment, outlet 30 may be at least 0.5 square inch, and in some embodiments is at least 1.0 square inch, and in other embodiments is preferably at least about 1.5 square inches; in one embodiment the area is at least about 3.5 square inches. It should be appreciated that the desired surface area of outlet 30 may be provided by a single opening, or several openings whose total area is equal to the desired area.

Substantially rigid surfaces 40, 42 may be constructed in any manner and of any material(s) that allow substantially rigid surfaces 40, 42 to apply relatively even pressure to bladder 20 when substantially rigid surfaces 40, 42 have pressure applied to them. For example, substantially rigid surfaces 40, 42 may include a board or other sheet of relatively rigid material, a net or fence-like structure, or a flexible material, such as cloth, held sufficiently taut to apply relatively even pressure to bladder 20.

The nature of substantially rigid surfaces 40, 42 may vary with the intended use of inflatable device 10. For example, where inflatable device 10 is intended for use as a bed or cot, such as illustrated in FIGS. 1 and 2, substantially rigid surfaces 40, 42 may take the form of a traditional mattress support. In some instances, such support may include a flexible material attached at its edges to a frame by springs, holding the flexible material relatively taut. In addition, second substantially rigid surface 42 may be constructed in the same or different manner from the first substantially rigid surface 40. As will be clear to those of skill in the art, substantially rigid surface 40, 42 may be constructed of a wide variety of materials, given a particular application.

Where inflatable device 10 includes more than one substantially rigid surface 40, 42, substantially rigid surfaces 40, 42 may be connected to one another. For example, substantially rigid surfaces 40, 42 may be connected to one another such that they may be opposed to one another, thereby improving the efficiency of deflation of bladder 20. Connecting substantially rigid surfaces 40, 42 may also allow an angle between them to be maintained, such as for use as a book stand. For example, substantially rigid surfaces 40, 42 may be connected via a hinge 50. Hinge 50 may be constructed in any manner that connects substantially rigid surfaces 40, 42 and allows them to be moved toward one another. For example, hinge 50 may be a separately constructed mechanical hinge located between and attached to substantially rigid surfaces 40, 42 or may be a flexible material, such as a portion of bladder 20 between substantially rigid surfaces 40, 42, where bladder 20 is connected to substantially rigid surfaces 40, 42.

In some embodiments, bladder 20 may be connected to substantially rigid surface(s) 40, 42. Otherwise, where first and second substantially rigid surfaces 40, 42 are used to deflate bladder 20, bladder 20 may be forced out from between substantially rigid surfaces 40, 42 where bladder 20 is not connected to substantially rigid surfaces 40, 42. Where it is desired to connect bladder 20 to substantially rigid surfaces 40, 42, this connection may take any form where the connection is capable of maintaining bladder 20 in contact with substantially rigid surfaces 40, 42 during deflation. In some embodiments, substantially rigid surfaces 40, 42 may be integrally formed with bladder 20. In other embodiments, the connection may be detachable, allowing bladder 20 to be removed for cleaning, repair, replacement, and the like. For example, bladder 20 and substantially rigid surfaces 40, 42 may be connected by hook and loop fasteners, snaps, zippers, buttons and equivalents thereto.

Figure 7:
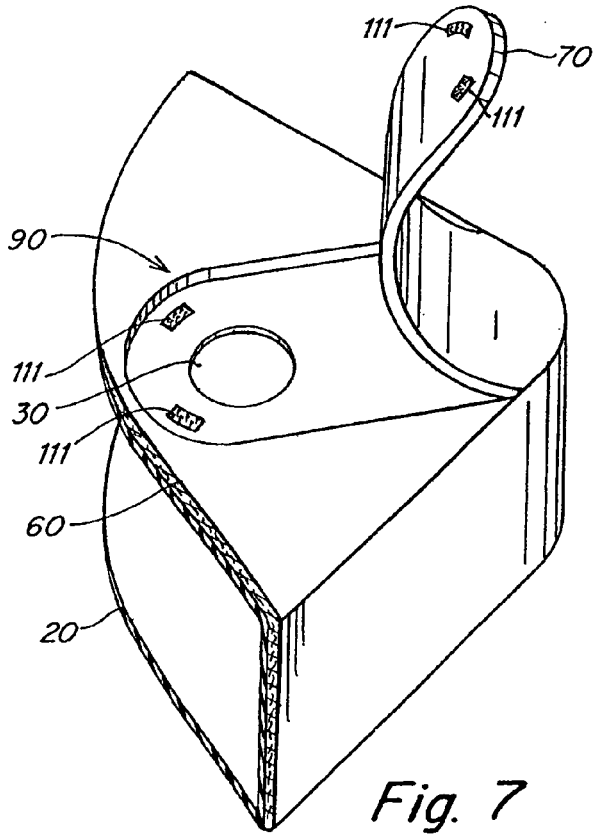
FIG. 7 is a cut-away, perspective view of an inflatable device according to another embodiment of the present invention.
Figure 8:
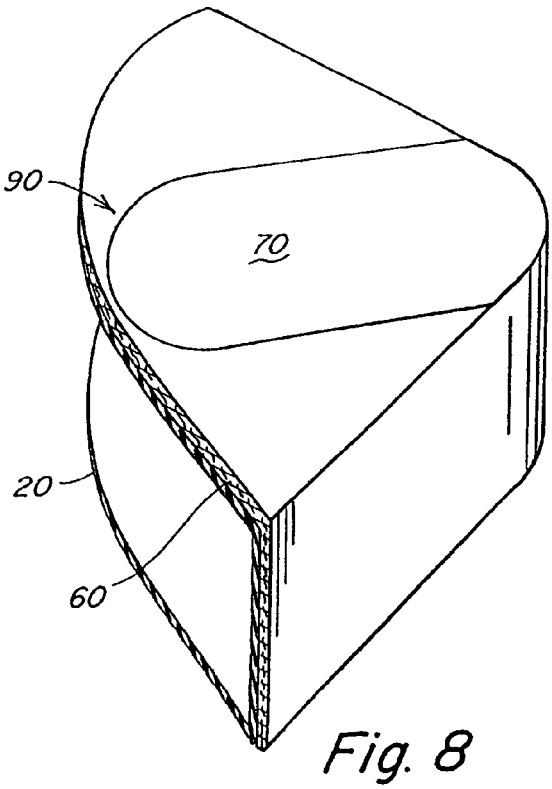
FIG. 8 is a cut-away, perspective view of the inflatable device of FIG. 7.
Figure 9:
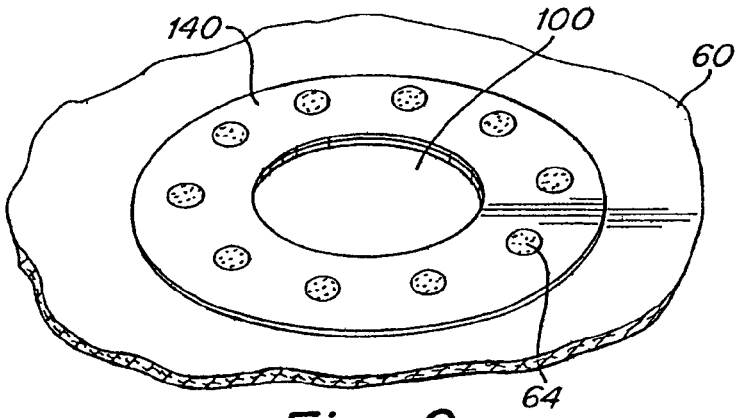
FIG. 9 is a perspective view of one aspect of the present invention.
Figure 10:
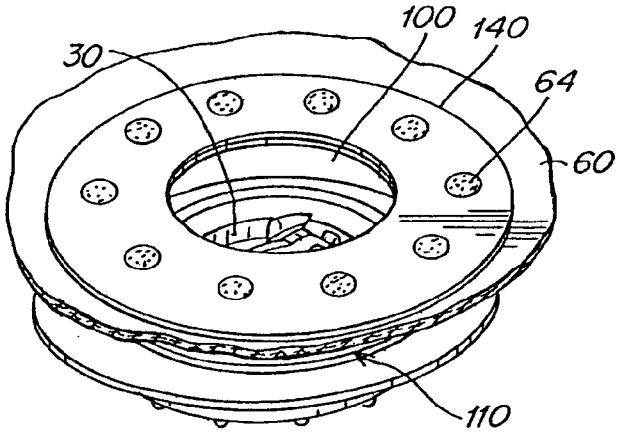
FIG. 10 is a perspective view of another aspect of the present invention.

Bladder 20 may include additional materials to improve the utility and comfort of bladder 20. For example, bladder 20 may include outer layers or coatings for durability, support or comfort. In some embodiments, bladder 20 may be coated with a material which is more pleasant to the touch than the material from which bladder 20 is constructed. Where inflatable device 10 is for use in supporting a person, bladder 20 may also include a layer to provide additional comfort, particularly where the person is to contact bladder 20. Accordingly, for a variety of reasons bladder 20 may include one or more covering layers 60, such as illustrated in FIGS. 7 and 8. For example, covering layer 60 may be located on a second surface of bladder 20, may improve the texture and feel of bladder 20 and, further, may allow air and moisture to pass between a person and bladder 20, preventing discomfort. As another example, covering layer 60 may be a protective layer.

Figure 19:
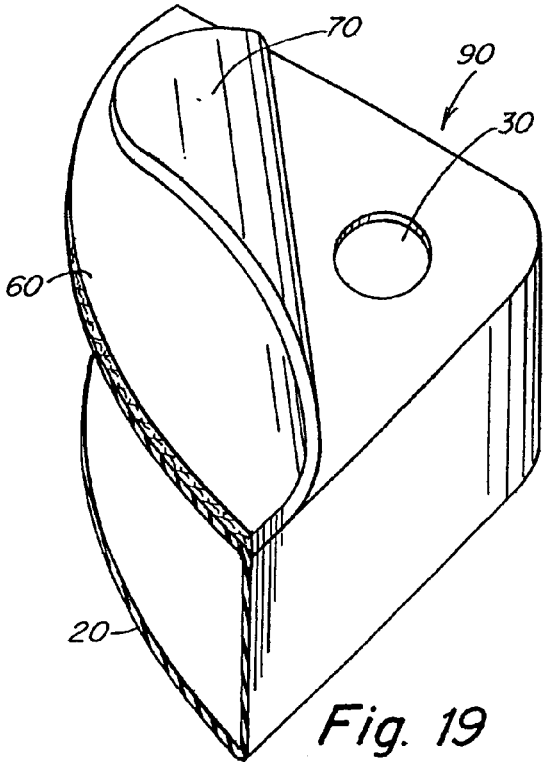
FIG. 19 is a cut-away, perspective view of an inflatable device according to another embodiment of the present invention.

In one embodiment, covering layer 60 may cover outlet 30, preventing it from interfering with the comfort of a person using inflatable device 10. Where covering layer 60 covers outlet 30, outlet 30 may be made easily accessible. For example, covering layer 60 may be constructed to be easily removed from bladder 20 or otherwise moved aside from outlet 30 (without removing the covering layer from the bladder or otherwise). In one embodiment, covering layer 60 may be easily removed from bladder 20 in the vicinity of outlet 30. For example, referring to FIGS. 7, 8 and 19, a portion of covering layer 60 may be removable from bladder 20 at an access point 90. Such portion of covering layer 60 may be constructed, for example, as a tab 70. Tab 70 may be constructed in any shape that allows it to selectively cover outlet 30 and not interfere with the comfort of a person using inflatable device 10. For example, tab 70 may include a securing device 111 for securing tab 70 to outlet 30, covering layer 60 and/or bladder 20. For example, tab 70 may include a snap, zipper, or hook and loop fastener (such as VELCRO® hook and loop fastener) arrangement.

In another embodiment, covering layer 60 may not cover outlet 30. Whether or not covering layer 60 covers outlet 30, it is preferred that the entire covering layer 30 also be removable from bladder 20 so that it may be cleaned, repaired, replaced, and the like. In embodiments where covering layer 60 does not cover outlet 30, and is removable from bladder 20, it may be desirable to align an opening in covering layer 60 with outlet 30 while maintaining ease of removability of covering layer 60.

One embodiment of an inflatable device 10 comprising a removable covering layer 60 is illustrated in FIGS. 9-18. In this embodiment, inflatable device 10 may include bladder 20, outlet 30, covering layer 60 having an opening 100, and an anchor 110 positioned proximate to outlet 30 and connected to bladder 20 and covering layer 60. It should be understood that the term "connected" does not imply a degree of permanency. For example, the connection between the covering layer and the anchor will typically be easily detachable, while the connection between the bladder and the anchor will typically be permanent.

Figure 11:
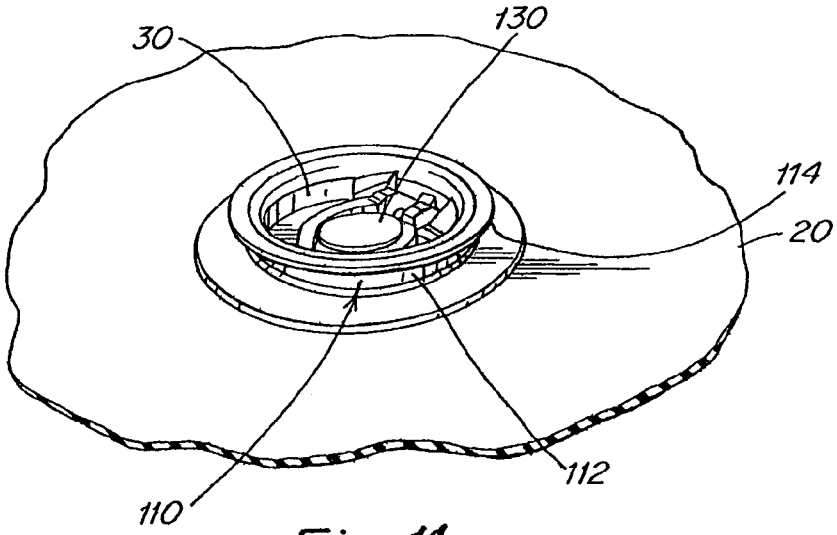
FIG. 11 is a perspective view of another aspect of the present invention.
Figure 12:
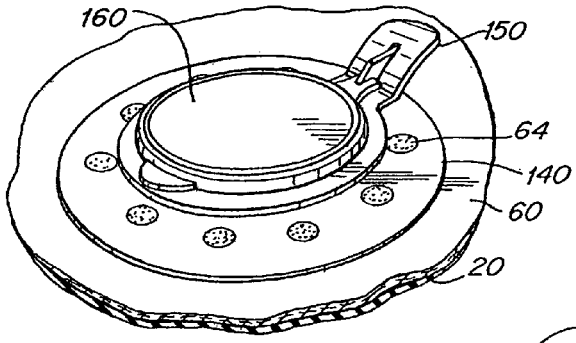
FIG. 12 is a perspective view of another aspect of the present invention.
Figure 13:
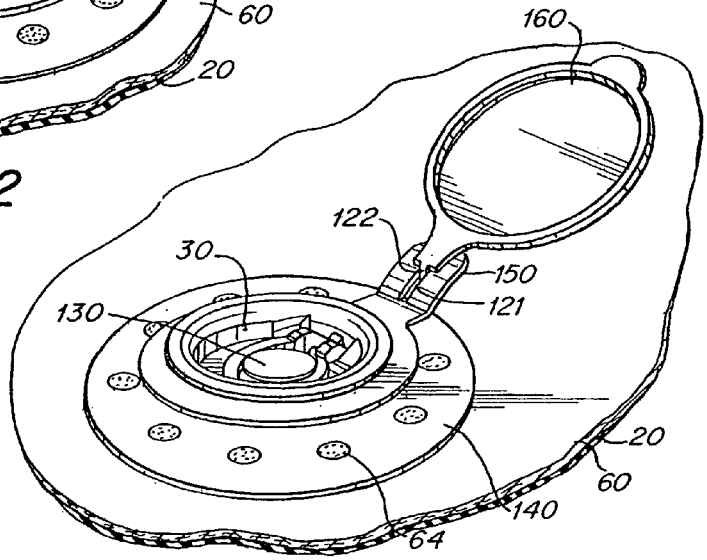
FIG. 13 is a perspective view of another aspect of the present invention.
Figure 14:
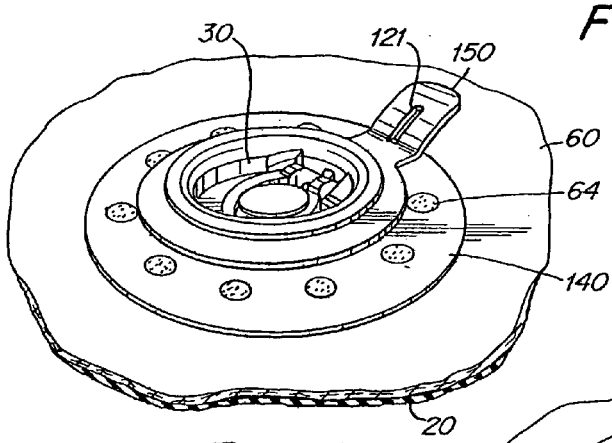
FIG. 14 is a perspective view of another aspect of the present invention.
Figure 15:
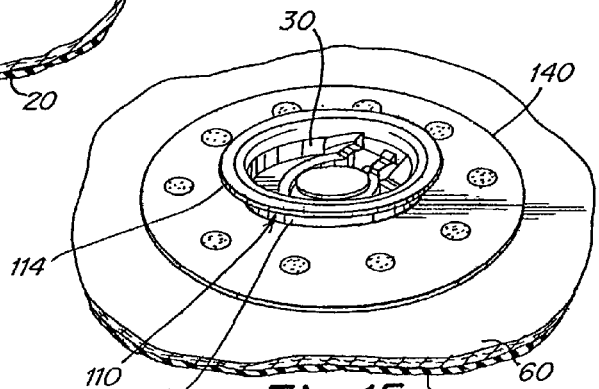
FIG. 15 is a perspective view of another aspect of the present invention.
Figure 16:
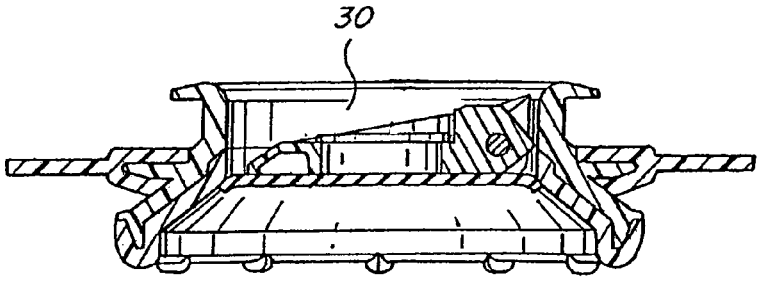
FIG. 16 is a cross-sectional view of another aspect of the present invention.
Figure 17:
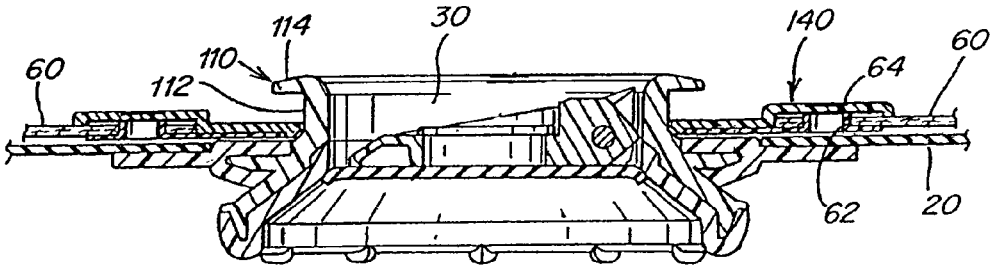
FIG. 17 is a cross-sectional view of another aspect of the present invention.
Figure 18:
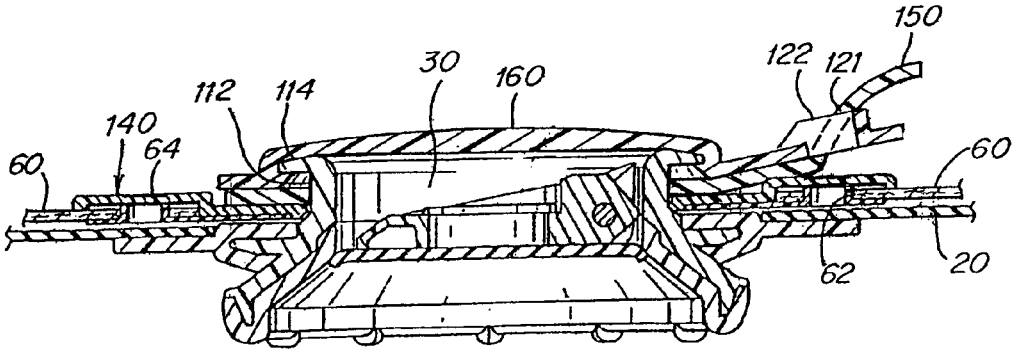
FIG. 18 is a cross-sectional view of another aspect of the present invention.

Anchor 110 may have any structure that removably connects to covering layer 60 such that outlet 30 is accessible through opening 100 and that is sufficiently firmly connected to bladder 20 for a particular application. For example, as illustrated in FIG. 11, anchor 110 may include a lip 112 surrounding outlet 30. Lip 112 may be contiguous, or may be constructed of a plurality of smaller elements. Lip 112 may include structure able to mate with comfort layer 60. For example, lip 112 may include an overhang 114.

Anchor 110 may be constructed of any material that allows anchor 110 to be removably connected to covering layer 60. Preferably, anchor 110 is constructed of a material that facilitates connection and disconnection of covering layer 110. For example, anchor 110 may be constructed of a flexible, or even elastomeric, material that is able to deform to allow connection and disconnection of covering layer 60. Where anchor 110 includes lip 112 and overhang 114, these may be flexed to allow opening 100 in covering layer 60 to fit over them. It should be appreciated that anchor 110 need not be flexible in all embodiments. For example, retainer 140 may allow sufficient flexing for connection and disconnection of retainer 140 and covering layer 60 to anchor 110, which may be rigid. Anchor 110 may be integrally formed with outlet 30, a valve structure 130, or separately constructed and connected. While this integrally formed arrangement is convenient, it is not required.

Opening 100 in covering layer 60 may be constructed in any manner that allows access to outlet 30. Preferably, opening 100 is constructed to facilitate removable connection with anchor 110. For example, opening 100 may be sized and adapted to mate with anchor 110. In the illustrated embodiment, removable connection is facilitated by a retainer 140 positioned around opening 30. Retainer 140 may be constructed in any shape that allows it to removably connect with anchor 110. For example, where anchor 110 includes a circular lip, retainer 140 may include a ring.

Retainer 140 may be constructed of any material that allows it to removably connect with anchor 110. For example, retainer 140 may be constructed of a material, such as elastomeric material, that is able to be stretched over structure associated with anchor 110. In one embodiment, retainer 140 includes a polymeric material. Retainer 140 may include multiple layers, such as multiple layers with covering layer 60 sandwiched between them. For example, retainer 140 may include two polymeric layers positioned on either side of the covering layer and connected together. Such a connection may be performed in any manner that provides sufficient durability. In one embodiment two polymeric layers are radio frequency (RF) sealed to one another to form retainer 140. Connection between layers of retainer 140 may be facilitated by modifying the structure of covering layer 60. For example covering layer 60 may include a plurality of holes 62 (see FIG. 18) in a portion of covering layer 60 positioned between the two polymeric layers, such that the polymeric layers are in direct contact with one another at the holes. Locations where the polymeric layers are in direct contact with one another through the holes in the covering layer are labeled 64 in the figures.

In some embodiments, it may be desirable for retainer 140 to extend beyond the edge of the opening 100. This arrangement may allow two layers of retainer 140 to be more easily connected and may also result in an overall thinner structure to mate with anchor 110. For example, in a variety of embodiments covering layer 60 may be relatively thick, such as where it is quilted or constructed of heavy-duty materials. In such embodiments, if covering layer 60 is sandwiched between two layers to form retainer 140, the overall structure may be relatively thick and inhibit connection with certain anchors. For example, where anchor 110 includes lip 112 and overhang 114, the distance beneath overhang 114, such as between overhang 114 and bladder 20, may be insufficient for retainer 140. This may be remedied by increasing this distance or by making retainer 140 thinner. For example, as described above, covering layer 60 and retainer 140 may be constructed such that covering layer 60 only extends into the outer portion of retainer 140 and does not extend into the portion of retainer 140 that connects with anchor 110.

In some embodiments, it may be desired to secure the connection between covering layer 60 and anchor 110 with a lock 150. Lock 150 may be constructed in any manner and using any materials that allow it to facilitate maintaining the connection between covering layer 60 and anchor 110. In one embodiment, lock 150 may be positioned around outlet 30 between overhang 114 and at least one of covering layer 60 and retainer 140. In this embodiment, it may be required to remove lock 150 before disconnecting covering layer 60 from anchor 110. One suitable lock 150 may comprise a ring of elastomeric material.

Inflatable device 10 may also include a cap 160 for outlet 30. Where inflatable device 10 includes cap 160, it may be desirable for cap 160 to be tethered to inflatable device 10 to inhibit loss of cap 160. In one embodiment, lock 150 may also serve as a tether, or a portion of a tether, for cap 160. In such an embodiment, the tether may be an extension of lock 150. The tether, remainder of lock 150 and cap 160 may be formed as one piece or irreversibly connected. However, according to one embodiment of the present invention, it is preferred that lock 150 and cap 160 be reversibly connectable. For example, cap 160 and lock 150 may include mating structures, such as a slot 121 and mating "T" shaped element 122 (see FIG. 13). In addition to allowing cap 160 to be detached from inflatable device 10 without removing lock 150, an arrangement of two mating structures may provide a joint or hinge about which the cap may move. This arrangement eliminates the problem of prior art cap tethers constructed of a single piece of material that develop a "memory" for a shape and attempt to return to that shape. Typically, this means that the cap in such prior art devices tends to close itself and may obstruct outlet 30.

It should be appreciated that anchor 110 and lock 150 including a tether for a cap 160 may find utility where there is no covering layer, or where covering layer 60 is not in use. In particular, connection of a cap to a lock, ring, or similar structure positioned on an anchor using mating structures may have utility in many applications.

Inflatable device 10 of the present invention may be inflated in any manner and using any device capable of moving fluid into bladder 20. For example, inflatable device 10 may be manually inflated by blowing into it or it may be inflated with a pump 80. Pump 80 may be any fluid pump, such as a conventional electric fluid pump. Pump 80 may force fluid through a conduit into, or out of, bladder 20. In some embodiments, the conduit may be positioned around the motor of the pump, as an annulus. According to one embodiment where a pump is used, the pump, such as pump 80, may be connected to bladder 20. Where pump 80 is connected to bladder 20, pump 80 may be configured so that it does not interfere with the use of inflatable device 10.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed:

1. An inflatable device, comprising:

a substantially fluid impermeable bladder having a first surface that is an outer surface of a wall of the bladder;

an outlet in the bladder; and a frame configured to support the bladder when the inflatable device is in use, the frame including:

a first substantially rigid surface including a first solid sheet of material, the first substantially rigid surface coupled to the first surface of the fluid impermeable bladder;

a second substantially rigid surface formed of a second sheet of material, the second substantially rigid surface coupled to the first surface of the fluid impermeable bladder; and a hinge connecting the first and second substantially rigid surfaces and configured to adjust an angle between the first and second substantially rigid surfaces through a range of angles including 0 degrees and 180 degrees;

wherein the first surface of the inflatable device and the first and second substantially rigid surfaces of the frame are configured in a U shaped configuration with the hinge at 0 degrees;

wherein the inflatable bladder is substantially planar and the first substantially rigid surface and the second substantially rigid surface collectively support the first surface of the fluid impermeable bladder in the substantially planar configuration with the hinge at 180 degrees and remain substantially in contact with more than half of the first surface of the fluid impermeable bladder with the hinge at 180 degrees, and wherein the first substantially rigid surface and the second substantially rigid surface remain substantially in contact with the first surface of the fluid impermeable bladder when the angle is adjusted through the range of angles including 0 degrees and 180 degrees.

2. The inflatable device of claim 1, wherein the outlet is positioned in a portion of the bladder distal to the hinge.

3. The inflatable device of claim 2, wherein the frame is configured to support a work piece and the bladder is positioned between the first and second substantially rigid surfaces such that inflation and deflation of the bladder adjusts the angle.

4. The inflatable device of claim 3, wherein the bladder and the first and second substantially rigid surfaces are configured such that the angle can be adjusted from 0 degrees to 90 degrees by inflation of the bladder.

5. The inflatable device of claim 3, wherein the first substantially rigid surface comprises a ridge to maintain the work piece on the first substantially rigid surface.

6. The inflatable device of claim 1, wherein the bladder is connected to at least one of the first and second substantially rigid surfaces.

7. The inflatable device of claim 1, further comprising a covering layer in contact with a second surface of the bladder which is an outer surface of a second wall of the bladder.

8. The inflatable device of claim 7, wherein the outlet is positioned between the covering layer and the bladder.

9. The inflatable device of claim 8, further comprising an access point providing access to the outlet.

10. The inflatable device of claim 9, wherein a portion of the covering layer covering the outlet includes a tab.

11. The inflatable device of claim 10, wherein the tab is removably connected to one of a remaining portion of the covering layer and the bladder.

12. The inflatable device of claim 1, wherein the bladder is shaped as a mattress and wherein the frame is included in a folding bed frame.

13. The inflatable device of claim 12 wherein the first and second substantially rigid surfaces comprise two sections of the folding bed frame.

14. The inflatable device of claim 1, wherein the bladder is shaped as a cushion and the first and second substantially rigid surfaces comprise two sections of a folding lap desk.

15. The inflatable device of claim 1, wherein the second substantially rigid surface is distinct from the first substantially rigid surface.

16. The inflatable device of claim 1, wherein the first substantially rigid surface and the second substantially rigid surface are connected together.

17. The inflatable device of claim 1, wherein the first substantially rigid surface and the second substantially rigid surface are substantially planar surfaces.

18. The inflatable device of claim 1, having a spacing for the first rigid surface, the second rigid surface, the bladder, and the hinge, such that a majority of the amount of air is expelled by moving the first rigid surface relative to the second rigid surface about the hinge when the outlet is open.

19. The inflatable device of claim 1, wherein the outlet comprises a self-sealing valve.

20. The inflatable device of claim 1, wherein the outlet has a combined area of at least one-half square inch, such that when the bladder is compressed between the first substantially rigid body and the second substantially rigid body, most of the fluid is rapidly expelled through the outlet.

21. The inflatable device of claim 1, wherein the at least one outlet comprises two outlets.

22. The inflatable device of claim 1, wherein inflation or deflation of the bladder adjusts the angle between the first and second substantially rigid surfaces.

23. The inflatable device of claim 22, wherein the inflatable device is configured to allow the angle to be adjusted from zero degrees to an angle of 90 degrees by inflation of the bladder.

24. The inflatable device of claim 1, wherein the hinge is configured to adjust the angle from 0 to 180 degrees.

25. The inflatable device of claim 1, wherein the first and second substantially rigid surfaces are included in the frame.

26. The inflatable device of claim 1, wherein the frame is configured to support one of a book, a magazine, a paper tablet, and a laptop computer.

27. The inflatable device of claim 1, wherein the first and second substantially rigid surfaces are each detachably connected to the first surface of the bladder.

28. The inflatable device of claim 1, wherein the first and second substantially rigid surfaces are each parallel to the first surface of the bladder when the hinge is configured at an angle of 180 degrees.

29. The inflatable device of claim 1, wherein at least one of the first substantially rigid surface and the second substantially rigid surface includes a sheet of flexible material.

30. The inflatable device of claim 1, wherein at least one of the first substantially rigid surface and the second substantially rigid surface includes a sheet of relatively rigid material.

31. An inflatable device, comprising a bladder having a first surface that is an outer surface of a wall of the bladder;

an outlet in the bladder;

a frame configured to support the bladder and including a first portion and a second portion of the frame;

a first substantially rigid surface including a first solid sheet of material, the first substantially rigid surface coupled to the first surface of the bladder and to the first portion of the frame;

a second substantially rigid surface formed of a second sheet of material, the second substantially rigid surface coupled to the first surface of the bladder and to the second portion of the frame; and a hinge connecting the first portion of the frame to the second portion of the frame and configured to adjust an angle between the first and second substantially rigid surfaces through a range of angles including 0 degrees and 180 degrees, wherein the first surface of the inflatable bladder and the first and second substantially rigid surfaces are configured in a U shaped configuration with the hinge at 0 degrees, wherein the first substantially rigid surface and the second substantially rigid surface collectively support the first surface of the bladder in a planar configuration and remain substantially in contact with more than half of the first surface of the fluid impermeable bladder with the hinge at 180 degrees, and wherein the first substantially rigid surface and the second substantially rigid surface remain substantially in contact with the first surface when the angle is adjusted through the range of angles including 0 degrees and 180 degrees.

32. The inflatable device of claim 31, wherein the hinge is configured to adjust the first and second substantially rigid surfaces to a coplanar position.

33. The inflatable device of claim 31, wherein the range of angles includes 90 degrees.

34. The inflatable device of claim 31, further comprising a covering layer in contact with a second surface of the bladder which is an outer surface of a second wall of the bladder.

35. The inflatable device of claim 34, wherein the outlet is positioned between the covering layer and the bladder.

36. The inflatable device of claim 34, wherein a portion of the covering layer covering the outlet includes a tab.

37. The inflatable device of claim 31, further comprising an access point providing access to the outlet.

38. The inflatable device of claim 31, wherein the outlet comprises a self-sealing valve.

39. An inflatable device, comprising:

a bladder having a first surface that is an outer surface of a wall of the bladder and a second surface that is an outer surface of a second wall of the bladder;

an outlet in the bladder;

a frame configured to support the bladder and including a first portion and a second portion of the frame;

a first substantially rigid surface including a first solid sheet of material, the first substantially rigid surface coupled to the first surface of the bladder and to the first portion of the frame;

a second substantially rigid surface formed of a second sheet of material, the second substantially rigid surface coupled to the first surface of the bladder and to the second portion of the frame;

a covering layer in contact with the second surface of the bladder, wherein at least a portion of the covering layer covers the outlet and includes a tab; and a hinge connecting the first portion of the frame to the second portion of the frame and configured to adjust an angle between the first and second substantially rigid surfaces through a range of angles including 0 degrees and 180 degrees, wherein the first substantially rigid surface and the second substantially rigid surface collectively support the first surface of the bladder in a planar configuration and remain substantially in contact with more than half of the first surface of the fluid impermeable bladder with the hinge at 180 degrees, wherein the first surface of the inflatable bladder and the first and second substantially rigid surfaces are configured in a U shaped configuration with the hinge at 0 degrees, and wherein the first substantially rigid surface and the second substantially rigid surface remain substantially in contact with the first surface of the fluid impermeable bladder when the angle is adjusted through the range of angles including 0 degrees and 180 degrees.

40. The inflatable device of claim 39, wherein the outlet is positioned between the covering layer and the bladder.

41. The inflatable device of claim 39, further comprising an access point providing access to the outlet.

42. The inflatable device of claim 39, wherein the tab is removably connected to one of a remaining portion of the covering layer and the bladder.

* * * * *